US006899636B2

(12) United States Patent
Finn

(10) Patent No.: US 6,899,636 B2
(45) Date of Patent: May 31, 2005

(54) GOLF PUTTER HAVING SPACED WEIGHT MEMBER

(76) Inventor: Charles A. Finn, 2955 Cottingham St., Oceanside, CA (US) 92054

( * ) Notice: Subject to any disclaimer, the term of this patent is extended or adjusted under 35 U.S.C. 154(b) by 25 days.

(21) Appl. No.: 09/934,967

(22) Filed: Aug. 22, 2001

(65) Prior Publication Data

US 2002/0025859 A1 Feb. 28, 2002

Related U.S. Application Data

(60) Provisional application No. 60/227,741, filed on Aug. 24, 2000.

(51) Int. Cl.[7] ..... A63B 53/04

(52) U.S. Cl. ..... 473/313; 473/255; 473/314; 473/341

(58) Field of Search ..... 473/255, 313, 473/314, 340, 341

(56) References Cited

U.S. PATENT DOCUMENTS

| | | | | | |
|---|---|---|---|---|---|
| 4,010,958 | A | | 3/1977 | Long | |
| 4,693,478 | A | | 9/1987 | Long | |
| 4,898,387 | A | | 2/1990 | Finney | |
| 5,046,740 | A | * | 9/1991 | D'Eath | 473/255 |
| 5,080,365 | A | * | 1/1992 | Winchell | 473/255 |
| 5,308,069 | A | | 5/1994 | Paquette | |
| 5,344,151 | A | * | 9/1994 | Anderson et al. | 473/337 |
| 5,464,218 | A | | 11/1995 | Schmidt et al. | |
| 5,470,070 | A | | 11/1995 | Bendo | |
| 5,700,207 | A | * | 12/1997 | Guthrie et al. | 473/313 |
| 5,716,290 | A | * | 2/1998 | Baker et al. | 473/313 |
| 6,663,497 | B2 | * | 12/2003 | Cameron | 473/245 |

* cited by examiner

*Primary Examiner*—Glenn Caldarola
*Assistant Examiner*—Tom P Duong
(74) *Attorney, Agent, or Firm*—John E. Wagner; Robert C. Smith

(57) ABSTRACT

A golf putter is formed with a clubhead including a striking face, added weight along the bottom at the rear of the clubhead to form a soleplate and weight added to the toe and heel portions. Secured to the back side of the clubhead is a rearwardly extending support member. An elongated cylindrical weight member secured to the end of the support member is centered thereon and extends parallel to the striking face. Additional embodiments are shown wherein the elongated weight member is positioned high at the rear of the clubface, or supported on the soleplate. In one alternative embodiment the weight is concealed in a cavity within the clubhead with its support member secured to a separate striking face member. In another embodiment, the weight member is faired into an open cavity and spaced from the walls of the cavity.

34 Claims, 5 Drawing Sheets

FIG. 1
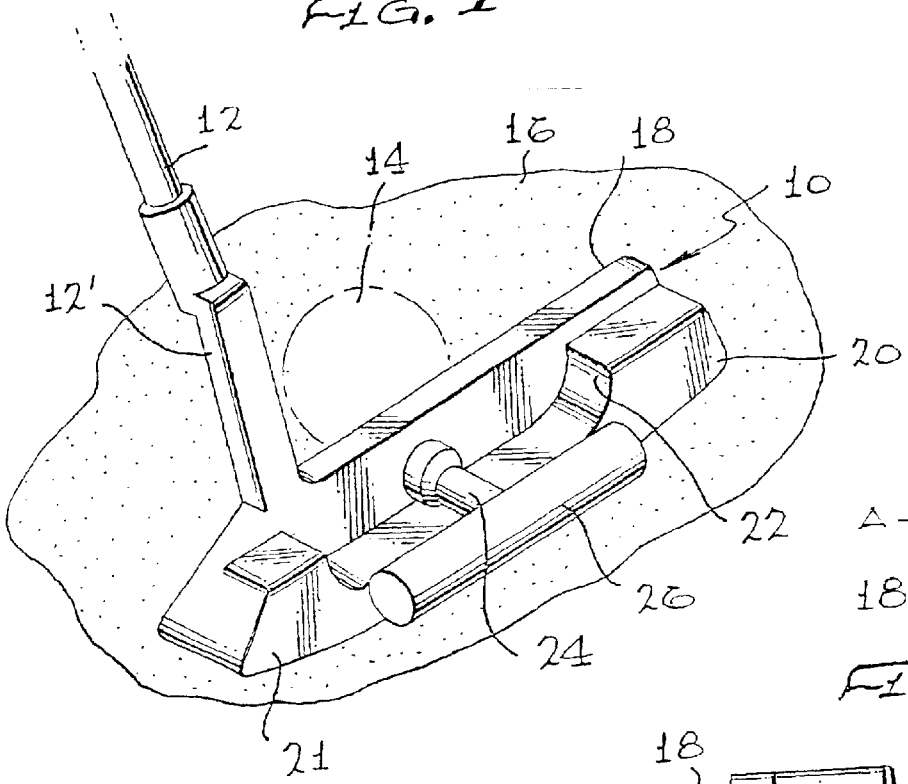
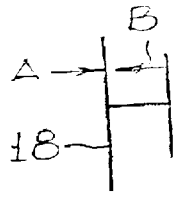
FIG. 4
FIG. 2
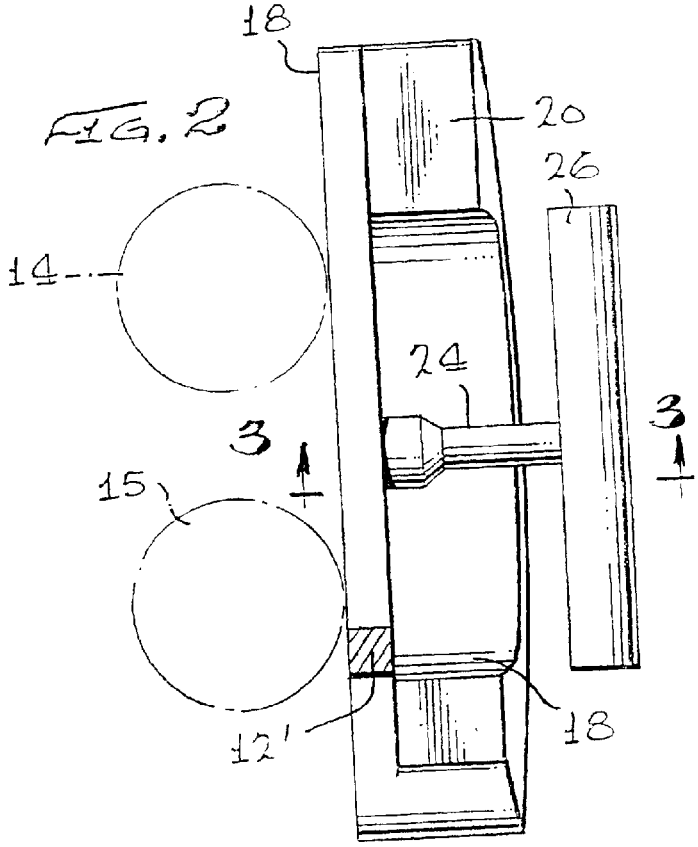
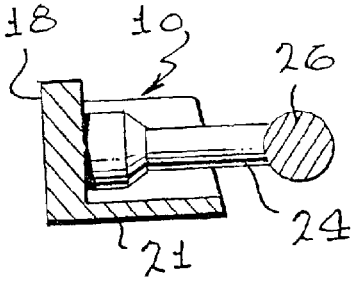
FIG. 3

FIG. 5
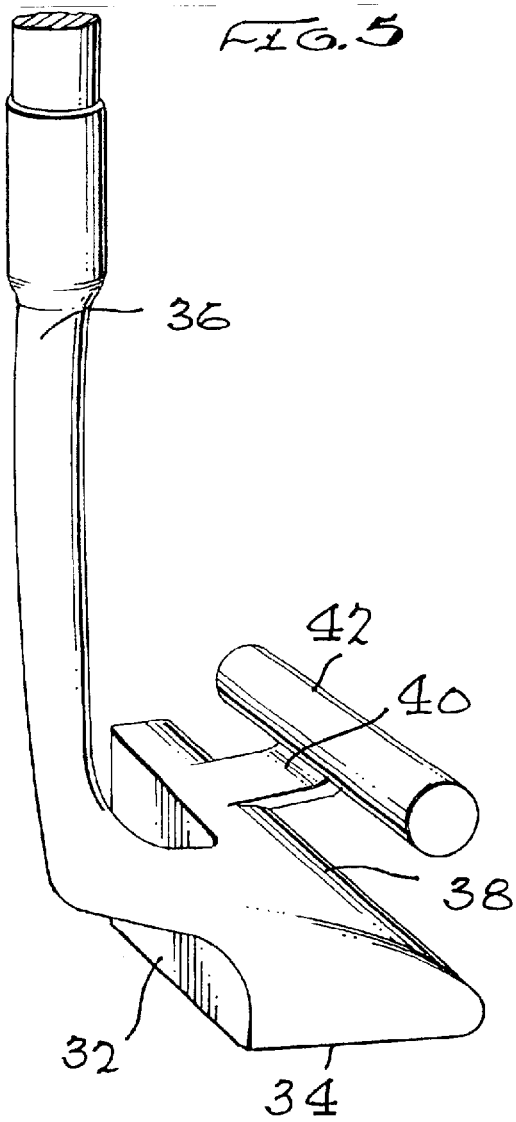
FIG. 6
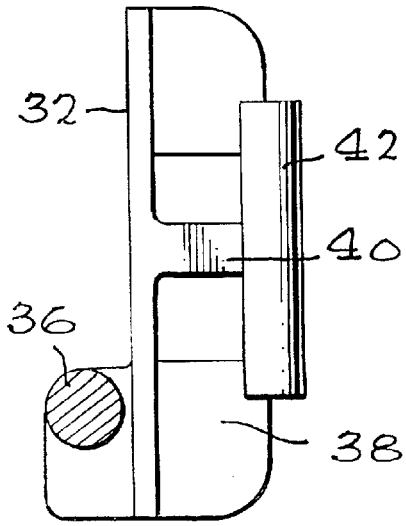
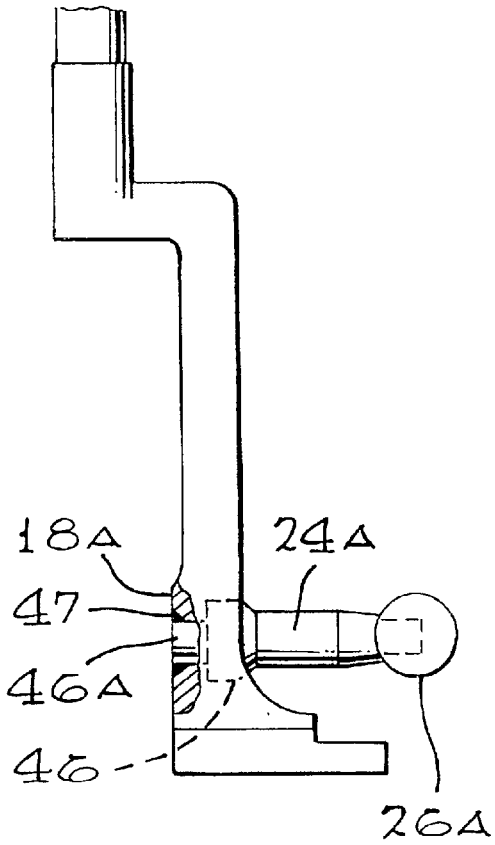
FIG. 7

FIG. 8
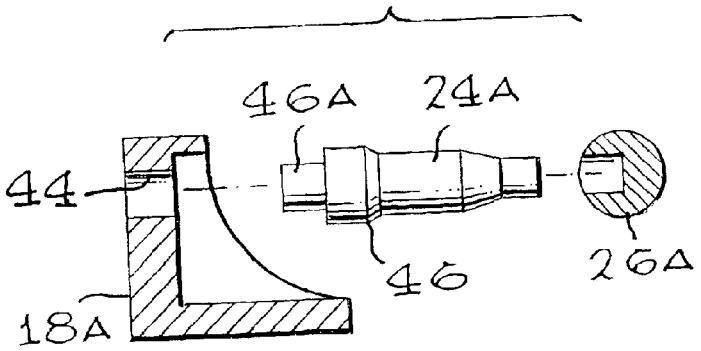
FIG. 9
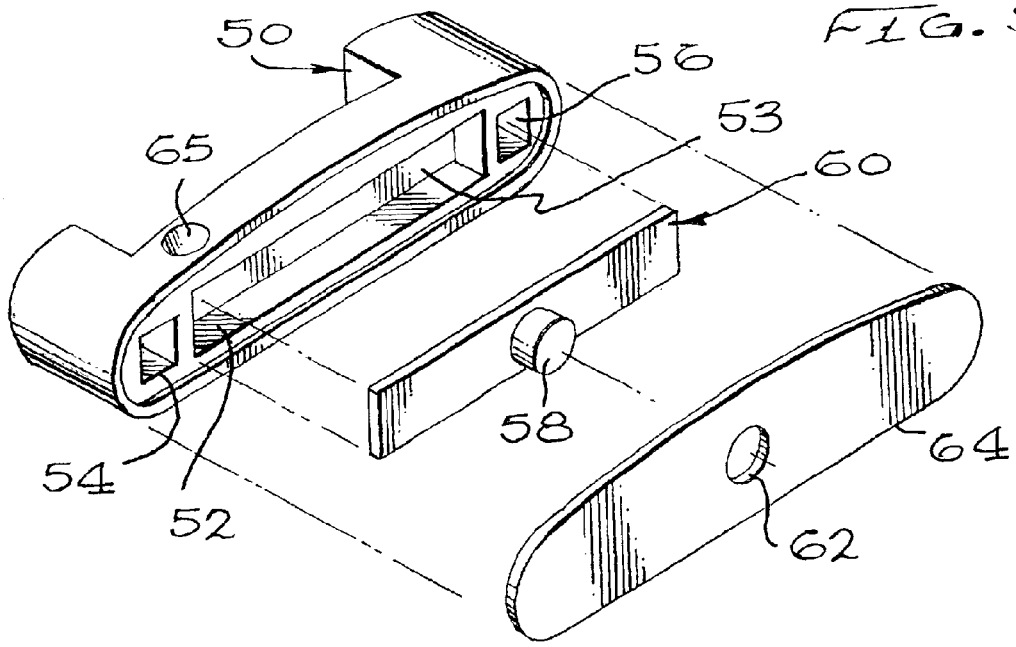
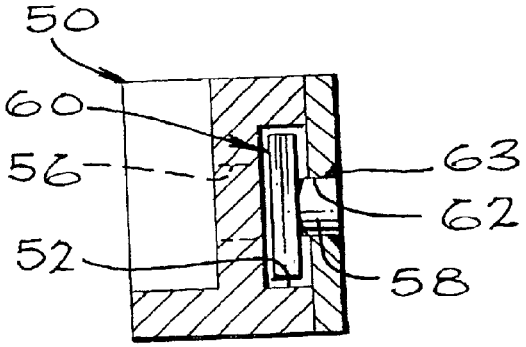
FIG. 11

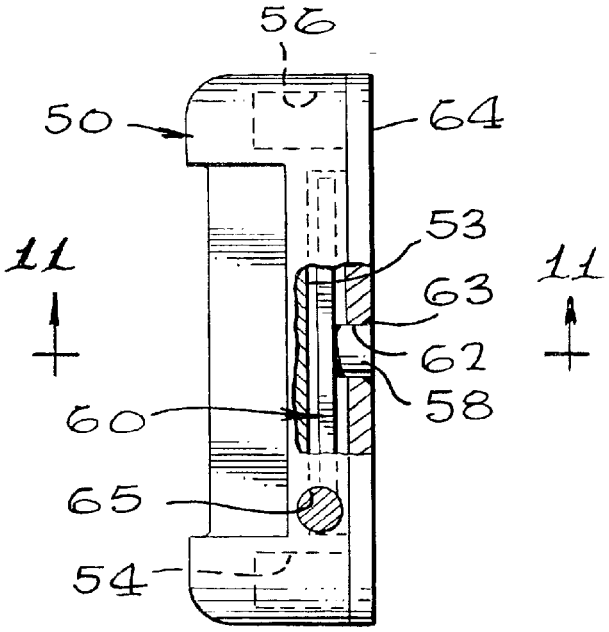
FIG. 10
FIG. 13
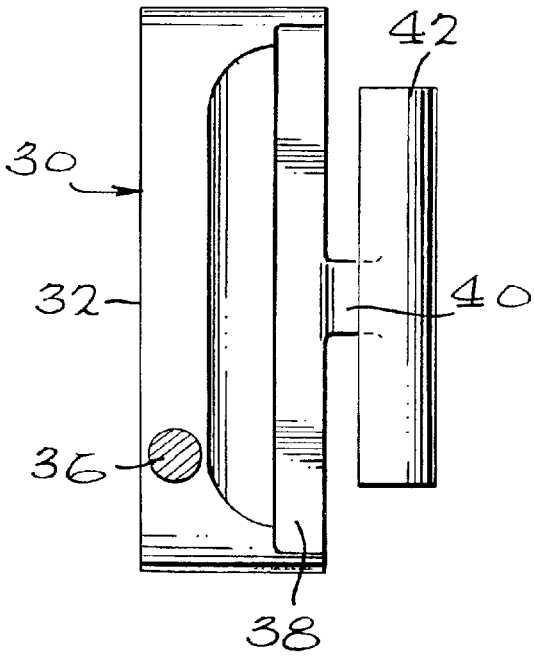
FIG. 12
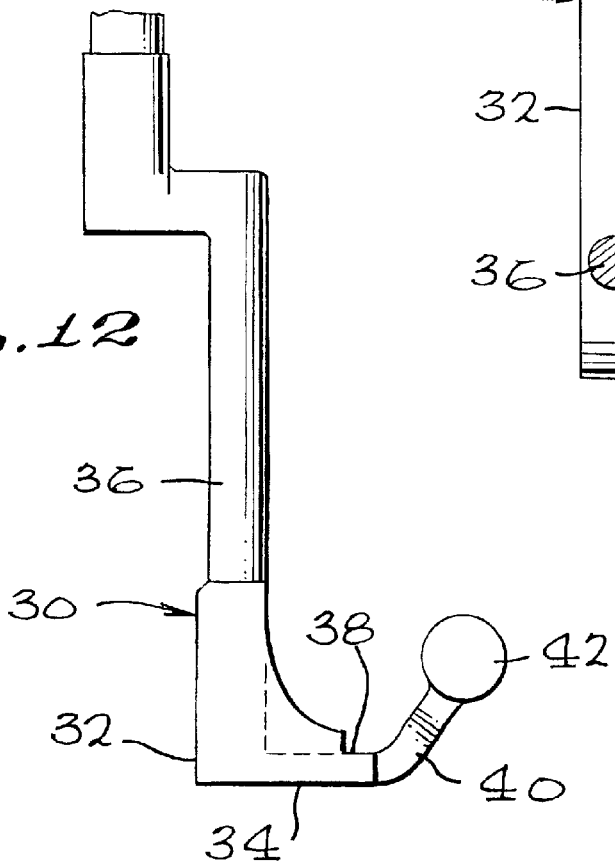

FIG. 14
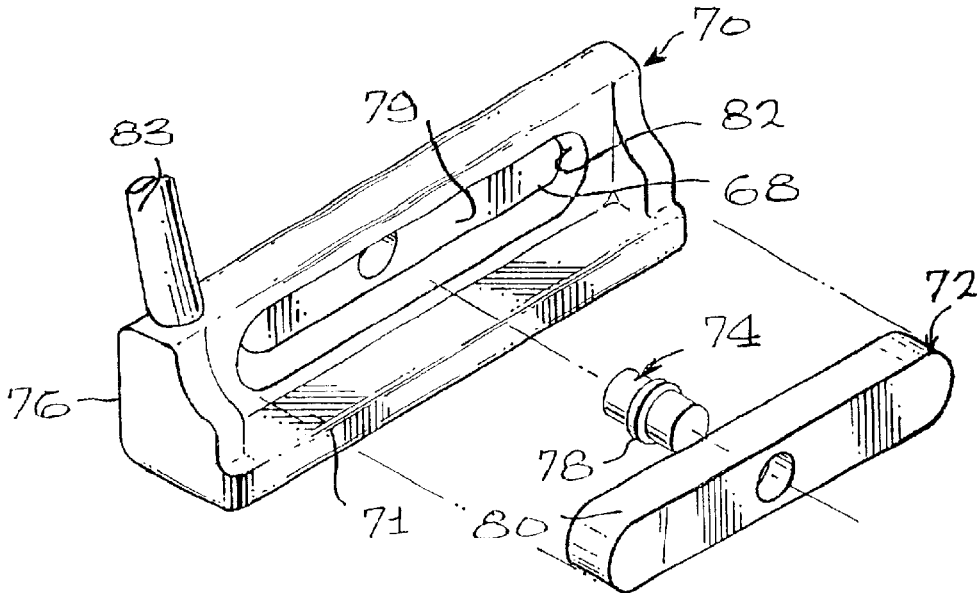
FIG. 15
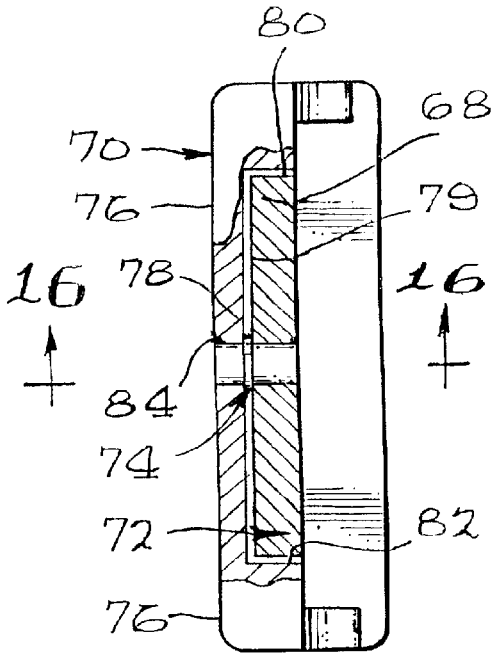
FIG. 17
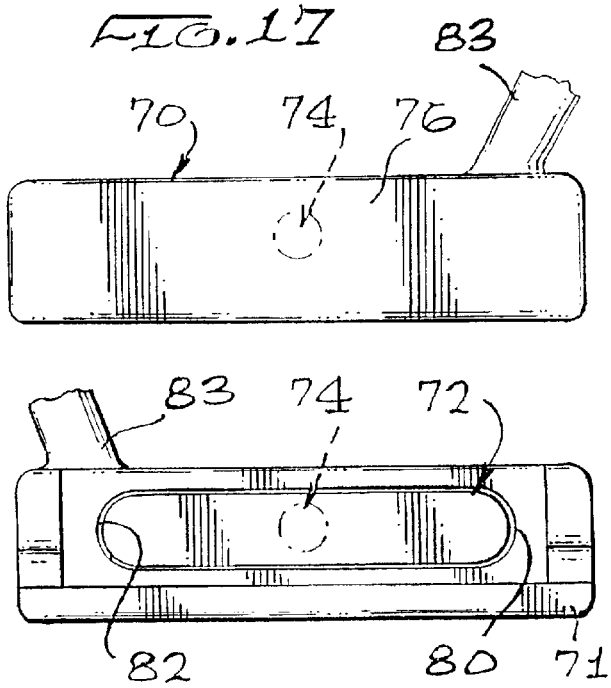
FIG. 18
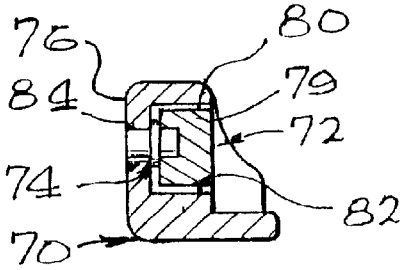
FIG. 16

GOLF PUTTER HAVING SPACED WEIGHT MEMBER

REFERENCE TO RELATED APPLICATION

This non-provisional patent application is based upon U.S. Provisional Patent Application Ser. No. 60/227,741 filed Aug. 24, 2000 and hereby claims the benefit of the filing date thereof.

BACKGROUND OF THE INVENTION

Because of the great interest in golf and golf equipment, there is a continuing effort to devise newer and better golf clubs. This applies to putters, as well as other clubs, and a visit to any well stocked golf professional's shop will disclose a number of designs of golf putters available. Variations include clubs, particularly putters, having heads with various amounts of offset from the shaft, various shapes of head and various weighting arrangements. Great effort has been expended in attempting to distribute the weight on the clubhead so that the club will swing straight and true.

Specifically, most golf putters today are weighted toward the bottom of the club with varying proportions of the weight placed toward the heel or the toe. The desirable weight distribution and the offset or lack of it are all features which give rise to very subjective reactions by individual golfers, which is probably the reason for the number of designs available. There seems to be no agreement as to an optimum putter design. Comparatively, recent putter designs are disclosed in U.S. Pat. Nos. 4,693,478; 4,898,387; 5,308,069; and 5,464,218. It does appear, however, that most of the later and more sophisticated designs attempt to arrange the weight around the clubhead to aid in providing as straight a swing as possible, with the least likelihood of hitting the ball off center, causing the ball to veer from the intended course. Nevertheless, most putters today require that the ball be hit squarely in the center and with the clubhead directly perpendicular to the intended direction of travel of the ball. It would be desirable for most golfers to have golf clubs, and particularly, putters, which are more forgiving of a stroke which is somewhat off center of the clubhead.

BRIEF SUMMARY OF THE INVENTION

Applicant has devised a golf putter which is believed to be more forgiving of an off-center contact with the golf ball than any heretofore available. This putter utilizes a significant proportion of the clubhead weight in the form of a bar extending parallel to the clubhead and spaced outwardly from the rear part of the clubhead by means of a short support or shaft centered on the bar and the clubhead.

As compared with a clubhead having an identical shape and having the extra weight simply cast into the back of the clubhead, applicant's new club clearly provides enhanced performance, especially in situations where the clubhead strikes the ball off center. The length of the rearwardly extended bar, as shown, is approximately half that of the main part of the clubhead, and a significant amount of testing indicates that the clubhead can hit the ball substantially off center without causing the ball to change its direction. Actually, an even longer bar could improve the clubhead performance somewhat more, but the additional length results in a heavier clubhead and less attractive appearance.

The length of the clubface over which the ball may be hit without causing the ball to be deflected is greater than the length of the spaced bar, as shown. Typically, the clubhead may be 4-⅞" long and the bar centered at the rear is 2-7/16" long. Experience with a putter made according to the invention indicates that improved performance is observed even if the point of impact with the ball is anywhere over the entire length of the striking face. Optimum performance will occur if the ball is hit within the length of the bar and a significantly improved performance is experienced even if the point of contact with the ball is outside the length of the bar.

In other embodiments, the weight member is mounted from the top of the putter, or near the bottom of the putter, as when it is carried on the soleplate. Applicant has also formed the weight and support as a "T-bar" which is welded into the clubhead with the end of the support flush with the striking face.

Another embodiment utilizes the same basic concept as the embodiments described above but conceals the bar in a chamber within the putter behind the striking face. In this embodiment, the bar or weight is preferably flat, supported at the center of a separate striking face member and unsupported at the ends such that its performance is similar to the other embodiments described above.

In a further embodiment, the clubface is formed with a cavity open to the rear and with the support extending into the cavity from the rear or back side of the striking face. The weight is secured to the support such that it is spaced from the bottom and sidewall of the cavity. The support is configured so that its exposed surface is substantially flush with the rear side of the clubhead, making the weight, if not concealed, at least not apparent to a casual observer.

Other objects and advantages will become apparent from consideration of the following description taken in connection with the drawings.

BRIEF DESCRIPTION OF THE DRAWINGS

This invention may be more clearly understood with the following detailed description and by reference to the drawings in which FIG. 1 is a rear perspective view of the clubhead according to the invention;

FIG. 2 is a plan view, partly in section, of the clubhead of FIG. 1;

FIG. 3 is a sectional view taken along line 3—3 of FIG. 2;

FIG. 4 is a force diagram indicating the theory of operation of the clubhead of FIGS. 1, 2, and 3;

FIG. 5 is a perspective view of another embodiment of the invention in which the rear support and weight are mounted high on the clubhead and formed integrally therewith;

FIG. 6 is a top view of the embodiment of FIG. 5;

FIG. 7 is a side elevational view of an additional embodiment of the invention in which the rear support extends through the striking face of the clubhead;

FIG. 8 is an exploded vertical sectional view of the clubhead of FIG. 7 taken along the centerline of the putter;

FIG. 9 is an exploded view of still another embodiment of the invention with a concealed weight member;

FIG. 10 is a top plan view of the embodiment of FIG. 9 with portions broken away to show the support and weight within a cavity;

FIG. 11 is a fragmentary sectional view taken along line 11—11 of FIG. 10;

FIG. 12 is a side view of a further embodiment of the invention with the support and weight secured to the sole plate of the clubhead;

FIG. 13 is a top view of the embodiment of FIG. 14;

FIG. 14 is an exploded rear perspective view of a still further embodiment of the invention with a weight member faired into the back side of the clubhead;

FIG. 15 is a top view of the clubhead of FIG. 14 with portions broken away;

FIG. 16 is a sectional view taken along line 16—16 of FIG. 15;

FIG. 17 is a front elevational view of the clubhead of FIGS. 14–16; and FIG. 18 is a rear elevational view of the clubhead of FIGS. 14–17

DESCRIPTION OF THE PREFERRED EMBODIMENTS

Referring now to FIG. 1, the putter clubhead 10 is secured to a shaft 12 by means of an integral hosel 12'. The hosel may also be a separate member attached to clubhead 10. The clubhead is shown addressing a bail 14, shown in phantom, on a putting green 16. The clubhead 10 includes a striking face 18 with a weighted portion 20 formed on the rear side. At the bottom of the weighted portion 20 is a soleplate 21. The weighted portion 20 extends toward the toe and heel of clubhead 10 but is cut out or relieved in the upper part of the center, as shown at numeral 22. A short rod or bar 24 is secured to, and cantilevered from, the rear side of the striking face 18 at the center of the cut out part 18, which is also essentially at the weight center of the clubhead 10. An elongated cylindrical weight 26 is secured at its exact center to bar 24 leaving the ends of weight 26 cantilevered from the point of attachment of weight 26 to bar 24.

FIG. 2 is a plan view of the clubhead 10 showing the clubface 18, the weighted portion 20, cutout part 18, bar 24, and the elongated cylindrical weight 26. The integral hosel 12' is shown in section. Member 26 is conveniently shown as cylindrical, although it could have other cross sections such as hexagonal so long as its weight is evenly balanced on opposite sides of its point of attachment to bar 24.

Golf balls 14 and 15 are shown in phantom adjacent to the striking face 18 to indicate that clubhead 10 could strike a ball off center of the clubhead at any point along its length from the location of ball 14 to that of ball 15 without causing the ball to travel off course. As stated above, the point of impact could be even further outboard and the ball will still travel straight. As shown in FIGS. 2 and 3, bar 24 is of such length that weight 26 extends rearwardly somewhat beyond the width of the main part of clubhead 10, including soleplate 21. Since bar 24 and weight 26 are normally threadedly engaged with clubhead 10, weight 26 must be able to be turned into clubhead 10 without interference from soleplate 21. With different attachment means, such as welding, bar 24 could be somewhat shorter.

FIG. 4 is a simplified force diagram indicating the effect of striking a ball substantially off center with a putter having the clubhead 10. When the clubhead 10 strikes the ball, a force is applied against the clubface 18 as shown by the arrow A. This causes a moment arm tending to turn or pivot the clubface 18 around its center toward the direction of the arrow A. This would normally cause the ball to be deflected from the desired path. With applicant's clubhead, the end of weight 26 on the side of the impact reacts because of its inertia with a compensating force toward the clubface (arrow B) which tends to oppose the tendency of the club to turn.

FIGS. 5–13 disclose embodiments not included in the Provisional Patent Application Ser. No. 60/227,741, referred to above.

FIG. 5 is a perspective view of another embodiment of the invention in this view, the clubhead 30 includes a clubface 32, a soleplate 34, an integral hosel 36, and a rear face 38. Extending from a position high on the rear face is a shaft or support 40 centered on an elongated cylindrical weight 42. A top view of this embodiment is shown in FIG. 6. Note that support 40 extends from the top of rear face 38. This embodiment is preferably cast as a single unitary piece.

FIGS. 7 and 8 are side elevational views and vertical sectional views, respectively, of a modified form of the clubhead of FIGS. 1–3 in which the support 24A and the cylindrical weight 26A form a T-bar which is welded in a hole or port 44 in the portion of the clubhead containing clubface 18. The clubhead 10 is bored to receive the stepped cylindrical insert 46 and the insert 46 is secured in place, preferably by welding in place with its tip 46A flush with clubface 18 preferably at the exact location of the club "sweet spot". Additionally, the weight member 26A, in the form of an elongated cylinder 26A is secured to a circular boss at the outer end of support 24A as by welding, brazing or epoxy bonding.

FIG. 9 is an exploded view of still another embodiment of the invention in which the spaced weight member is concealed within a clubhead 50, which is hollowed out to form a chamber 52 extending over most of its length. Clubhead 50 may contain additional bores 54, 56 for receiving additional weight members (not shown). A cylindrical support member 58 carries an elongated weight 60 and is seated in a bore 62 centered in a faceplate 64. A bore 65 provides a means for attaching a separate hosel and/or shaft.

FIG. 10 is a top view of the clubhead 50 of FIG. 9 showing the chamber 52, bores 54 and 56, support member 58, and weight member 60 in phantom; and FIG. 11 is a sectional view taken along line 11—11 of FIG. 10. For clarity, the spacing between weight member 60, the back face 53 of chamber 52, and the faceplate 64 is somewhat exaggerated, the normal spacing being in the order of 0.015 to 0.020 in. Weight member 60 would normally be of a material such as tungsten, which is substantially heavier than the other material of clubhead 50, which may be of aluminum. It will be recognized that the ends of weight member 60 are unsupported and free to respond to the impact of the clubhead 50 on a golf ball just as described in connection with FIG. 4. Once the parts are in position, as shown, they are secured by welding or by an epoxy adhesive.

FIG. 12 is a perspective view of a further embodiment of the invention in which the clubhead 90 is preferably cast as a single unitary piece, including a hosel 91, and the elongated weight member 92 is supported on the soleplate 94 of the clubhead, in this embodiment, the support 93 may be integral with or directly supported on the rearwardly extending soleplate 94.

The clubheads described have been formed of 431 stainless steel, but they can be formed of any material in common use for manufacturing putters, such as various alloys of aluminum, titanium or brass.

FIG. 13 is a top view of the clubhead 90 of FIG. 12.

FIG. 14 is an exploded rear perspective view of an embodiment of the invention in which the weight is faired into a cavity or chamber 68 on the back side of a clubhead 70 which includes a soleplate 71. A weight member 72 is supported on a short shaft or support 74, which is welded or otherwise secured to the striking face 76 of clubhead 70. A small collar 78 on support 74 spaces weight member 72 away from the bottom or vertical wall 79 of cavity 68.

Weight member 72 is sized to provide for a small clearance, such as 0.010 to 0.020 inch between its edge surface 80 and the sidewall 82 of cavity 68. It will thus be appreciated that the weight 72 is unsupported on its ends and has clearance all around its edges and is therefore free to respond to an impact with a golf ball in the same manner as described above. The weight member 72 is smoothly faired into the back surface of the clubhead in such manner that it is not readily apparent that it is a separate weight. A shaft of hosel 83 is secured to clubhead 70.

FIG. 15 is a top view of clubhead 70 with a portion of its top broken away along with a portion of weight member 72 to show the manner in which collar 78 on support 74 serves to space weight member 72 away from the vertical wall 79 of cavity 68. Again, the clearance between cavity sidewall 82 and weight member 72, and between vertical wall 79 and weight member 72 is somewhat exaggerated for clarity. The support 74 is shown welded to the striking face 76 at numeral 84.

FIG. 16 is a sectional view taken along line 16—16 of FIG. 15. Visible in this view are clubhead 70, weight member 72, and support 74 with collar 78. The wall 79 of cavity 68 is shown along with sidewall 82. Welds 84 are also shown.

FIGS. 17 and 18 are front and rear elevational views, respectively, of clubhead 70. Although support 74 is welded to striking face 76, this connection would be barely visible, if at all, on a finished clubhead, as shown in FIG. 17. Hosel 83 is shown secured to clubhead 70.

FIG. 18 shows clubhead 70, soleplate 71, hosel 83, and weight member 72 with weight member 72 shown clear of sidewall 82.

The above-described embodiments of the present invention are merely descriptive of its principles and are not to be considered limiting. The scope of the present invention instead shall be determined from the scope of the following claims including their equivalents.

I claim:

1. A golf putter with a clubhead comprising a body having an upstanding striking face, a generally horizontal soleplate:

the improvement thereon comprising a weight member support extending rearwardly from said rear side of said body and an elongated weight member secured to said support, said weight member being supported at its center substantially above the level of said soleplate, and extending generally laterally with respect to said striking face with each end of said weight member being unsupported and cantilevered from its attachment to said support.

2. A golf putter as claimed in claim 1 wherein said support and weight member together are generally T-shaped and the base of said T-shape is secured to the rear of the body of said clubhead and said weight member constitutes the head of the T-shape cantilevered from the point of attachment of said support to said body.

3. A golf putter as claimed in claim 1 wherein the length of said weight member is approximately half the length of said striking face.

4. A golf putter as claimed in claim 1 wherein said weight member is generally cylindrical.

5. A golf putter as claimed in claim 1 wherein said support is of such length that said weight member is displaced rearwardly from said rear striking face body beyond the width of said soleplate.

6. A golf putter as claimed in claim 5 wherein said includes a bore through the center of the striking region and one end of said support is secured in said bore in a position to contact a golf ball when the ball is struck at the center of said ball striking region.

7. A golf putter in accordance with claim 1 wherein said weight member is positioned by said support above and to the rear of the top surface of said body.

8. A golf putter as claimed in claim 1 wherein said body includes a bore through said striking face and one end of said support is secured in said bore and is exposed to said striking face.

9. A golf putter as claimed in claim 1 wherein said weight member support extends above and to the rear of the top surface of said body.

10. A golf putter having a clubhead with an upstanding striking face, a generally horizontal soleplate, a rear face, a shaft, and means for attaching said clubhead to said shaft;

a support spaced above said soleplate having a first end secured at said rear face and a second end, said support extending perpendicularly to the rear face of said clubhead opposite the sweet spot thereof; and an elongated weight member secured to the second end of said support and centered thereon, said weight member extending generally parallel to the generally horizontal soleplate and cantilevered from the point of attachment of said weight member to said support such that the ends of said weight are unsupported.

11. A golf putter as claimed in claim 10 wherein said support and weight members are generally T-shaped and are cantilevered from the point of attachment of said support to said rear face.

12. A golf putter as claimed in claim 10 wherein said clubhead includes a bore therethrough and one end of said support is secured in said bore and exposed at said striking face.

13. A golf putter having a handle shaft, a clubhead with a striking face portion, a soleplate, and means for attaching said clubhead to said handle shaft, said clubhead including rearwardly extending weighted portions at the toe and heel of said clubhead, and a recessed section at the back side of said clubhead not including said soleplate or said weighted portions, the improvement thereon comprising:

a single support shaft spaced above said soleplate and extending perpendicularly rearwardly from said recessed section and centered on the rear side of said striking face portion; and an elongated weight member secured to said support shaft and centered thereon, said weight member extending generally parallel to the soleplate to said striking face portion and unsupported at its ends, whereby an impact with a ball by said striking face portion creating a moment tending to turn the clubface is substantially compensated for the inertial action of the weight member.

14. A golf puffer as claimed in claim 13 wherein said clubhead includes a top surface and a rear surface, and said support extends from the top of said rear surface of said clubhead.

15. A golf putter as claimed in claim 13 wherein said clubhead striking face portion having a sweet spot includes a bore extending therethrough from said recessed portion to said striking face portion and said support is secured into said bore and aligned with the sweet spot of said striking surface.

16. A golf putter as claimed in claim 13 wherein said support shaft and weight member are generally T-shaped and cantilevered from the point of attachment of said support to said recessed section.

17. A golf putter as claimed in claim 13 wherein said weight member is generally cylindrical.

18. A golf putter as claimed in claim 13 wherein said support shaft is of such length that said weight member is displaced rearwardly from said striking face beyond the width of said soleplate.

19. A golf putter with a clubheed comprising a body having a striking face and a generally horizontal soleplate, the improvement thereon comprising:

a support vertically spaced from said soleplate extending rearwardly with respect to the striking face from the back side of said striking face and centered thereon and an elongated weight member attached at its center to said support with said weight member being evenly balanced on opposite sides of its attachment to said support, said weight member being located above said soleplate and unsupported at its ends.

20. A golf putter as claimed in claim 19 wherein said weight member extends generally parallel to said striking face and the soleplate.

21. A golf putter as claimed in claim 19 wherein said unsupported ends of said weight member are cantilevered from the point of attachment of said weight member to said support.

22. A golf clubhead as claimed in claim 19 wherein each end of said weight member is cantilevered generally laterally from its point of attachment to said support.

23. A golf putter having a shaft, a club head with a striking face portion, a rear side, and a soleplate, the improvement comprising:

a single support member spaced above said soleplate and cantilevered rearwardly from said rear side of said clubhead; and an elongated weight member secured to said support member and centered thereon, said weight member extending generally laterally with respect to said striking face portion and unsupported at its ends, whereby an impact with a ball on said striking face portion creates a moment arm tending to turn the clubface which is substantially compensated by the inertial action of the cantilevered support and weight members.

24. A golf putter with a clubhead including a striking face having a sweet spot, a back side, and a generally horizontal soleplate, a support member spaced above said soleplate and having a longitudinal axis extending rearwardly from said back side aligned with the sweet spot and a weight member secured to said support member above said soleplate and symmetrically disposed about the longitudinal axis of said support member and unsupported at its ends.

25. A golf clubhead comprising a face member having a striking face and a back surface and a soleplate;

a support member having a first end and a second end, said support member being coupled at said first end to said face member back surface above said soleplate; and a weight member attached to said support member second end, said weight member being supported at its center with each end of said weight member being cantilevered from, its point of attachment to said support member and extending laterally above said sole plate to provide free ended weight portions above said sole plate.

26. The golf clubhead of claim 25 wherein said clubhead is a putter head.

27. The golf clubhead of claim 25 wherein said face member has a sweet spot and said support member is coupled to said clubhead directly behind the sweet spot of said face member.

28. A golf putter comprising a body having a striking face and a rear surface opposite said striking face and a soleplate;

a support member having a first end and a second end, said support member being coupled at said first end to said body rear surface; and a weight member attached at its center to said support member second end, said weight member and said body being coupled such that the soleplate of said body is lower than said support member and weight member;

the ends of said weight member being unsupported and cantilevered from the attachment of said weight member to said support member second end.

29. A golf putter having a clubhead which is elongated between a heel end thereof and a toe end thereof, which has a substantially fiat and substantially vertical front ball-striking face and which has a bottom sole surface generally normal to the striking face, the putter including:

an elongated weight member which has end portions disposed substantially symmetrically relative to its mid length;

the weight member being disposed rearwardly from the clubhead striking face and disposed substantially symmetrically relative to the striking face laterally from the mid-length of the weight member;

the weight member also being disposed above the clubhead sole surface and in a plane substantially parallel to the sole surface;

the putter further including a weight member support connected only between the mid length of the weight member and the clubhead at a selected location on the clubhead; and the weight member end portions extending in unsupported cantilever manner from the connection to the support to the weight member.

30. A golf putter according to claim 29 in which the connection of the support to the weight member is aligned substantially normally from the clubhead striking face with a sweet spot of the clubhead.

31. A golf puffer according to claim 29 in which the connection of the support to the clubhead is aligned substantially normally from the clubhead striking face with a sweet spot of the clubhead.

32. A golf putter according to claim 31 in which the connection of the support to the weight member and of the support to the clubhead are aligned substantially normally from the clubhead striking face with a sweet spot of the clubhead.

33. A golf putter according to claim 32 in which the support is substantially horizontally disposed.

34. A golf putter according to claim 29 in which the support is substantially horizontally disposed.

* * * * *

UNITED STATES PATENT AND TRADEMARK OFFICE

CERTIFICATE OF CORRECTION

PATENT NO. : 6,899,636 B2
DATED : May 31, 2005
INVENTOR(S) : Charles A. Finn

It is certified that error appears in the above-identified patent and that said Letters Patent is hereby corrected as shown below:

Column 3,
Line 12, add a period at the end
Line 18, change “bail” to -- ball --

Column 4,
Line 51, after “clubhead” cancel the comma and insert a period; after the inserted period, capitalize “in”

Column 5,
Line 66, after “said” insert -- body --

Column 7,
Line 8, change “clubheed” to -- clubhead --
Line 19, after “substantially”, change “fiat” to -- flat --

Signed and Sealed this

Ninth Day of August, 2005

JON W. DUDAS
*Director of the United States Patent and Trademark Office*